US008494399B2

(12) United States Patent
Miyabe et al.

(10) Patent No.: US 8,494,399 B2
(45) Date of Patent: Jul. 23, 2013

(54) PROCESS CARTRIDGE AND ELECTROPHOTOGRAPHIC IMAGE FORMING APPARATUS

(75) Inventors: Shigeo Miyabe, Numazu (JP); Takahito Ueno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/423,449

(22) Filed: Mar. 19, 2012

(65) Prior Publication Data

US 2012/0177395 A1 Jul. 12, 2012

Related U.S. Application Data

(62) Division of application No. 12/915,799, filed on Oct. 29, 2010, now Pat. No. 8,155,554, which is a division of application No. 12/715,747, filed on Mar. 2, 2010, now Pat. No. 7,945,185, which is a division of application No. 12/245,110, filed on Oct. 3, 2008, now Pat. No. 7,702,251, which is a division of application No. 11/401,330, filed on Apr. 11, 2006, now Pat. No. 7,450,877.

(30) Foreign Application Priority Data

Apr. 11, 2005 (JP) ..... 2005-113398

(51) Int. Cl.
*G03G 15/00* (2006.01)

(52) U.S. Cl.
USPC ..... 399/90; 399/111

(58) Field of Classification Search
USPC ..... 399/75, 90, 110, 111, 113, 114
See application file for complete search history.

(56) References Cited

U.S. PATENT DOCUMENTS

| | | | |
|---|---|---|---|
| 5,585,889 | A | 12/1996 | Shishido et al. |
| 5,867,751 | A | 2/1999 | Nomura et al. |
| 5,926,666 | A | 7/1999 | Miura et al. |
| 5,937,239 | A | 8/1999 | Watanabe et al. |
| 5,950,047 | A | 9/1999 | Miyabe et al. |
| 6,029,031 | A | 2/2000 | Yokomori et al. |
| 6,064,843 | A | 5/2000 | Isobe et al. |
| 6,072,968 | A | 6/2000 | Nomura et al. |
| 6,128,452 | A | 10/2000 | Miyabe et al. |
| 6,167,219 | A | 12/2000 | Miyamoto et al. |
| 6,215,969 | B1 | 4/2001 | Nomura et al. |
| 6,272,300 | B1 | 8/2001 | Fujiwara et al. |

(Continued)

FOREIGN PATENT DOCUMENTS

| | | |
|---|---|---|
| JP | 4-299375 | 10/1992 |
| JP | 2002-229415 | 8/2002 |

*Primary Examiner* — Hoan Tran
(74) *Attorney, Agent, or Firm* — Fitzpatrick, Cella, Harper & Scinto

(57) ABSTRACT

A cartridge is detachably mountable to an electrophotographic image forming apparatus having a main assembly electrical contact. The cartridge includes: an electrophotographic photosensitive member; a memory; a cartridge electrical contact electrically connectable to the main assembly electrical contact; a contact including the cartridge electrical contact; and a support supporting the contact. The support includes first and second regulators of the contact member in widthwise and thickness directions, respectively, with a gap therebetween. Also provided is an opening permitting insertion of the contact into the support that opens in one direction perpendicular to the widthwise and thickness directions. The main assembly electrical contact includes a spring movable by a stroke in the contact thickness direction, and the gap of the second regulator W1, a length W2 of the contact in the thickness direction, the stroke U satisfy, W2<W1, and (W1−W2)<U.

11 Claims, 10 Drawing Sheets

U.S. PATENT DOCUMENTS

| | | | | |
|---|---|---|---|---|
| 6,282,390 | B1 | 8/2001 | Miyabe et al. | |
| 6,336,017 | B1 | 1/2002 | Miyamoto et al. | |
| 6,588,871 | B2 | 7/2003 | Studholme et al. | |
| 6,898,391 | B2 | 5/2005 | Numagami et al. | |
| 6,898,392 | B2 * | 5/2005 | Karakama et al. | 399/90 |
| 6,912,365 | B2 | 6/2005 | Ueno et al. | |
| 6,922,534 | B2 | 7/2005 | Goto et al. | |
| 6,934,485 | B2 | 8/2005 | Miyabe et al. | |
| 6,954,600 | B2 | 10/2005 | Fujita et al. | |
| 6,954,601 | B2 | 10/2005 | Numagami et al. | |
| 6,993,264 | B2 * | 1/2006 | Oguma et al. | 399/90 |
| 7,003,247 | B2 | 2/2006 | Koishi et al. | |
| 7,003,250 | B2 | 2/2006 | Sano et al. | |
| 7,072,603 | B2 | 7/2006 | Tsuzuki et al. | |
| 7,092,658 | B2 | 8/2006 | Yasumoto et al. | |
| 7,136,604 | B2 | 11/2006 | Chadani et al. | |
| 7,194,220 | B2 | 3/2007 | Sasaki et al. | |
| 7,433,622 | B2 | 10/2008 | Chadani et al. | |
| 7,450,877 | B2 | 11/2008 | Miyabe et al. | |
| 7,702,251 | B2 | 4/2010 | Miyabe et al. | |
| 2003/0123896 | A1 | 7/2003 | Goto et al. | |
| 2005/0176299 | A1 | 8/2005 | Chadani et al. | |
| 2006/0067725 | A1 | 3/2006 | Miyabe et al. | |
| 2010/0158556 | A1 | 6/2010 | Miyabe et al. | |

* cited by examiner (a)

(b)

PROCESS CARTRIDGE AND ELECTROPHOTROGRAPHIC IMAGE FORMING APPARATUS

CROSS REFERENCE TO RELATED APPLICATIONS

This application is a divisional of U.S. patent application Ser. No. 12/915,799, filed Oct. 29, 2010, which is a divisional of U.S. patent application Ser. No. 12/715,747, filed Mar. 2, 2010, now U.S. Pat. No. 7,945,185, which is a divisional of U.S. patent application Ser. No. 12/245,110, filed on Oct. 3, 2008, now U.S. Pat. No. 7,702,251, which is a divisional of application Ser. No. 11/401,330, filed Apr. 11, 2006, now U.S. Pat. No. 7,450,877.

FIELD OF THE INVENTION AND RELATED ART

The present invention relates to a process cartridge and an electrophotographic image forming apparatus employing a process cartridge.

According to a process cartridge system employed by an electrophotographic image forming apparatus, an electrophotographic photosensitive drum and one or more processing means are integrally disposed in a cartridge, making it possible for a user himself to maintain an electrophotographic image forming apparatus, instead of relying on service personnel. Therefore, a process cartridge system can substantially improve an electrophotographic image forming apparatus in operational efficiency. Thus, a process cartridge system is widely used in the field of an electrophotographic image forming apparatus.

Among the process cartridges which are currently in use, some of them are equipped with a memory (IC memory) for storing the information to be transmitted to the main assembly of an electrophotographic image forming apparatus, making it possible for the information to be exchanged between the main assembly and a process cartridge as the process cartridge is mounted into the main assembly. Further, it has been proposed to use this setup to inform the control portion of the main assembly of the state of a process cartridge, for example, the history of the cartridge usage.

More specifically, such information as the lot number of a process cartridge, characteristics of an image forming apparatus, characteristics of the processing means, etc., are registered in the memory in a process cartridge, making it easier to maintain the apparatus main assembly and/or process cartridge. Further, the image forming process is controlled according to the information stored in the memory, making it possible to form an image under optimal conditions.

As one of the methods for establishing an electrical connection between the main assembly of an image forming apparatus and the memory in a process cartridge, there has been known a connecting method of the contact type, which establishes an electrical connection with the use of connectors and springy members. This method has been widely used because it is simple in structure, and also, advantageous in terms of cost.

There have also been known various methods for firmly attaching a memory to a process cartridge. One of such methods is to use two-sided adhesive tape or the like to attach a memory to a process cartridge. This method is effective when a relatively large surface is available as the area to which a memory is to be attached. There have also been known a memory attaching method which directly inserts a memory into the frame of a process cartridge, and a memory attaching method which thermally welds a memory to the frame of a process cartridge. These methods have been used in the case of an image forming apparatus in which signals are exchanged between its main assembly and the process cartridge therein, with no physical contact between the main assembly and the process cartridge.

There are prior art publications: U.S. Pat. No. 5,937,239, U.S. Patent Application Publication 2003-0123896, and Japanese Laid-open Patent Application 2002-229415.

The present invention is one of the results of further development of the above described prior art.

SUMMARY OF THE INVENTION

The primary object of the present invention is to provide a process cartridge to which electrical contacts can be easily attached, and also, an electrophotographic image forming apparatus employing such a process cartridge.

Another object of the present invention is to provide a process cartridge structured so that its electrical contacts are fully exposed to ensure that an electrical connection is established and maintained between the electrical contacts of the cartridge and the electrical contacts of the main assembly of an image forming apparatus, and also, an electrophotographic image forming apparatus employing such a process cartridge.

Another object of the present invention is to provide a process cartridge, to which electrical contacts can be easily attached, and from which electrical contacts can be easily removed, and also, an electrophotographic image forming apparatus employing such a process cartridge.

According to an aspect of the present invention, there is provided a process cartridge detachably mountable to a main assembly of an electrophotographic image forming apparatus having a main assembly electrical contact. The process cartridge comprises: an electrophotographic photosensitive member; process means actable on the electrophotographic photosensitive member; a memory element for storing information relating to the process cartridge; a cartridge electrical contact electrically connectable to the main assembly electrical contact for transmitting the information from the memory element to the main assembly of the electrophotographic image forming apparatus; and a contact member including the cartridge electrical contact; supporting means for supporting the contact member, the supporting means including a first regulating portion for regulating movement of the contact member in a widthwise direction, the first regulating portion being disposed with a gap therebetween; a second regulating portion for regulating movement of the contact member in a thickness direction perpendicular to the widthwise direction, the second regulating portion being disposed with a gap therebetween; and an opening for permitting insertion of the contact member into the supporting means, wherein the opening opens in one direction which is a direction of height and which is perpendicular to the widthwise direction and to the thickness direction. The main assembly electrical contact includes a spring movable by a predetermined stroke in the thickness direction of the contact member, and the gap of the second regulating portion $W1$, a length $W2$ of the contact member in the thickness direction, the stroke U satisfy, $W2<W1$, and $(W1-W2)<U$.

According to another aspect of the present invention, there is provided a process cartridge detachably mountable to a main assembly of an electrophotographic image forming apparatus having a main assembly electrical contact. The process cartridge comprises: an electrophotographic photosensitive member; process means actable on the electrophotographic photosensitive member; a memory element for storing information relating to the process cartridge; a cartridge electrical contact electrically connectable to the main assembly electrical contact for transmitting the information from the memory element to the main assembly of the electrophotographic image forming apparatus; a contact member including the cartridge electrical contact; and supporting means for supporting the contact member. The supporting means includes a first regulating portion for regulating movement of the contact member in a widthwise direction, the first regulating portion being disposed with a gap therebetween; a second regulating portion for regulating movement of the contact member in a thickness direction perpendicular to the widthwise direction, the second regulating portion being disposed with a gap therebetween. The cartridge also includes an opening for permitting insertion of the contact member into the supporting means, wherein the opening opens in one direction which is a direction of height and which is perpendicular to the widthwise direction and to the thickness direction; and an exposing portion for exposing the cartridge electrical contact of the contact member. The length W3 of the exposing portion, a length W4 of the cartridge electrical contact, the gap W5 of the first regulating portion, and a length W6 of the contact member in the widthwise direction satisfy, W3>W4; W5>W6; (W3−W4)>(W5−W6).

According to a further aspect of the present invention, there is provided a process cartridge detachably mountable to a main assembly of an electrophotographic image forming apparatus having a main assembly electrical contact. The process cartridge comprises an electrophotographic photosensitive member; process means actable on the electrophotographic photosensitive member; a memory element for storing information relating to the process cartridge; a cartridge electrical contact electrically connectable to the main assembly electrical contact for transmitting the information from the memory element to the main assembly of the electrophotographic image forming apparatus; a contact member including the cartridge electrical contact; and supporting means for supporting the contact member. The supporting means includes a first regulating portion for regulating movement of the contact member in a widthwise direction, the first regulating portion being disposed with a gap therebetween; a second regulating portion for regulating movement of the contact member in a thickness direction perpendicular to the widthwise direction, the second regulating portion being disposed with a gap therebetween. The cartridge also includes an opening for permitting insertion of the contact member into the supporting means, wherein the opening opens in one direction which is a direction of height and which is perpendicular to the widthwise direction and to the thickness direction; and a retaining portion for preventing disengagement of the contact member from the supporting means after the contact member is inserted into the supporting means.

According to a further aspect of the present invention, there is provided a process cartridge detachably mountable to a main assembly of an electrophotographic image forming apparatus having a main assembly electrical contact, the process cartridge comprising an electrophotographic photosensitive member; process means actable on the electrophotographic photosensitive member; a memory element for storing information relating to the process cartridge; a cartridge electrical contact electrically connectable to the main assembly electrical contact for transmitting the information from the memory element to the main assembly of the electrophotographic image forming apparatus; a contact member including the cartridge electrical contact; and supporting means for supporting the contact member. The supporting means includes a first regulating portion for regulating movement of the contact member in a widthwise direction, the first regulating portion being disposed with a gap therebetween; and a second regulating portion for regulating movement of the contact member in a thickness direction perpendicular to the widthwise direction, the second regulating portion being disposed with a gap therebetween. The cartridge also includes an opening for permitting insertion of the contact member into the supporting means, wherein the opening opens in one direction which is a direction of height and which is perpendicular to the widthwise direction and to the thickness direction; and a recess for freeing a projection projected from a surface which is opposite a surface having the cartridge electrical contact of the contact member.

According to a further aspect of the present invention, there is provided a process cartridge detachably mountable to a main assembly of an electrophotographic image forming apparatus having a main assembly electrical contact, the process cartridge comprising a frame; an electrophotographic photosensitive member; process means actable on the electrophotographic photosensitive member; a memory element for storing information relating to the process cartridge; a cartridge electrical contact electrically connectable to the main assembly electrical contact for transmitting the information from the memory element to the main assembly of the electrophotographic image forming apparatus; a contact member including the cartridge electrical contact; and supporting means, provided on the frame, for supporting the contact member. The supporting means includes a first regulating portion for regulating movement of the contact member in a widthwise direction, the first regulating portion being disposed with a gap therebetween; and a second regulating portion for regulating movement of the contact member in a thickness direction perpendicular to the widthwise direction, the second regulating portion being disposed with a gap therebetween. The cartridge also including an opening for permitting insertion of the contact member into the supporting means, wherein the opening opens in one direction which is a direction of height and which is perpendicular to the widthwise direction and to the thickness direction, wherein the cartridge electrical contact supported by the supporting means is not projected beyond a surface of the frame but is exposure to an outside.

According to a further aspect of the present invention, there is provided an electrophotographic image forming apparatus for forming an image on a recording material. The electrophotographic image forming apparatus comprises a process cartridge and a main assembly to which the process cartridge is detachably mountable.

The main assembly of the electrophotographic image forming apparatus comprises a main assembly electrical contact movable by a predetermined stroke, a mounting portion for mounting the process cartridge, and feeding means for feeding the recording material.

The process cartridge comprises: an electrophotographic photosensitive member; process means actable on the electrophotographic photosensitive member; a memory element for storing information relating to the process cartridge; a cartridge electrical contact electrically connectable to the main assembly electrical contact for transmitting the information from the memory element to the main assembly of the electrophotographic image forming apparatus; a contact member including the cartridge electrical contact; and supporting means for supporting the contact member. The supporting means includes a first regulating portion for regulating movement of the contact member in a widthwise direction, the first regulating portion being disposed with a gap therebetween; and a second regulating portion for regulating movement of the contact member in a thickness direction perpendicular to the widthwise direction, the second regulating portion being disposed with a gap therebetween. The cartridge also includes an opening for permitting insertion of the contact member into the supporting means, wherein the opening opens in one direction which is a direction of height and which is perpendicular to the widthwise direction and to the thickness direction, wherein the gap of the second regulating portion W1, a length W2 of the contact member in the thickness direction, the stroke U satisfy, W2<W1, and (W1−W2)<U.

According to a further aspect of the present invention, there is provided an electrophotographic image forming apparatus for forming an image on a recording material. The electrophotographic image forming apparatus comprises a process cartridge and a main assembly to which the process cartridge is detachably mountable.

The main assembly of the electrophotographic image forming apparatus comprises a main assembly electrical contact movable by a predetermined stroke, a mounting portion for mounting the process cartridge, and feeding means for feeding the recording material.

The process cartridge comprises an electrophotographic photosensitive member; process means actable on the electrophotographic photosensitive member; a memory element for storing information relating to the process cartridge; a cartridge electrical contact electrically connectable to the main assembly electrical contact for transmitting the information from the memory element to the main assembly of the electrophotographic image forming apparatus; a contact member including the cartridge electrical contact; and supporting means for supporting the contact member. The supporting means includes a first regulating portion for regulating movement of the contact member in a widthwise direction, the first regulating portion being disposed with a gap therebetween; and a second regulating portion for regulating movement of the contact member in a thickness direction perpendicular to the widthwise direction, the second regulating portion being disposed with a gap therebetween. The cartridge also includes an opening for permitting insertion of the contact member into the supporting means, wherein the opening opens in one direction which is a direction of height and which is perpendicular to the widthwise direction and to the thickness direction; and an exposing portion for exposing the cartridge electrical contact of the contact member; wherein a length W3 of the exposing portion, a length W4 of the cartridge electrical contact, the gap W5 of the first regulating portion, and a length W6 of the contact member in the widthwise direction satisfy W3>W4, W5>W6, and (W3−W4)>(W5−W6).

According to a further aspect of the present invention, there is provided an electrophotographic image forming apparatus for forming an image on a recording material. The electrophotographic image forming apparatus comprises a process cartridge and a main assembly to which the process cartridge is detachably mountable.

The main assembly of the electrophotographic image forming apparatus comprises a main assembly electrical contact movable by a predetermined stroke, a mounting portion for mounting the process cartridge, and feeding means for feeding the recording material.

The process cartridge comprises: an electrophotographic photosensitive member; process means actable on the electrophotographic photosensitive member; a memory element for storing information relating to the process cartridge; a cartridge electrical contact electrically connectable to the main assembly electrical contact for transmitting the information from the memory element to the main assembly of the electrophotographic image forming apparatus; a contact member including the cartridge electrical contact; and supporting means for supporting the contact member. The supporting means includes a first regulating portion for regulating movement of the contact member in a widthwise direction, the first regulating portion being disposed with a gap therebetween; and a second regulating portion for regulating movement of the contact member in a thickness direction perpendicular to the widthwise direction, the second regulating portion being disposed with a gap therebetween. The cartridge also provides an opening for permitting insertion of the contact member into the supporting means, wherein the opening opens in one direction which is a direction of height and which is perpendicular to the widthwise direction and to the thickness direction; and a retaining portion for preventing disengagement of the contact member from the supporting means after the contact member is inserted into the supporting means.

According to a further aspect of the present invention, there is provided an electrophotographic image forming apparatus for forming an image on a recording material. The electrophotographic image forming apparatus comprises a process cartridge and a main assembly to which the process cartridge is detachably mountable.

The main assembly of the electrophotographic image forming apparatus comprises: a main assembly electrical contact movable by a predetermined stroke, a mounting portion for mounting the process cartridge, and feeding means for feeding the recording material.

The process cartridge comprises, an electrophotographic photosensitive member; process means actable on the electrophotographic photosensitive member; a memory element for storing information relating to the process cartridge; a cartridge electrical contact electrically connectable to the main assembly electrical contact for transmitting the information from the memory element to the main assembly of the electrophotographic image forming apparatus; a contact member including the cartridge electrical contact; and supporting means for supporting the contact member. The supporting means includes a first regulating portion for regulating movement of the contact member in a widthwise direction, the first regulating portion being disposed with a gap therebetween; and a second regulating portion for regulating movement of the contact member in a thickness direction perpendicular to the widthwise direction, the second regulating portion being disposed with a gap therebetween. The cartridge also includes an opening for permitting insertion of the contact member into the supporting means, wherein the opening opens in one direction which is a direction of height and which is perpendicular to the widthwise direction and to the thickness direction; and a recess for freeing a projection projected from a surface which is opposite a surface having the cartridge electrical contact of the contact member.

According to a further aspect of the present invention, there is provided an electrophotographic image forming apparatus for forming an image on a recording material. The electrophotographic image forming apparatus comprises a process cartridge and a main assembly to which the process cartridge is detachably mountable.

The main assembly of the electrophotographic image forming apparatus comprises a main assembly electrical contact movable by a predetermined stroke, a mounting portion for mounting the process cartridge, and feeding means for feeding the recording material.

The process cartridge comprises: a frame; an electrophotographic photosensitive member; process means actable on the electrophotographic photosensitive member; a memory element for storing information relating to the process cartridge; a cartridge electrical contact electrically connectable to the main assembly electrical contact for transmitting the information from the memory element to the main assembly of the electrophotographic image forming apparatus; a contact member including the cartridge electrical contact; and the supporting means for supporting the contact member. The supporting means includes a first regulating portion for regulating movement of the contact member in a widthwise direction, the first regulating portion being disposed with a gap therebetween; and a second regulating portion for regulating movement of the contact member in a thickness direction perpendicular to the widthwise direction the second regulating portion being disposed with a gap therebetween. The cartridge also includes an opening for permitting insertion of the contact member into the supporting means, wherein the opening opens in one direction which is a direction of height and which is perpendicular to the widthwise direction and to the thickness direction, wherein the cartridge electrical contact supported by the supporting means is not projected beyond a surface of the frame but is exposure to an outside.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Next, the process cartridge, and the electrophotographic image forming apparatus employing the process cartridge, in the first embodiment of the present invention will be described with reference to the appended drawings.

[General Structure of Multicolor Image Forming Apparatus]

Figure 1:
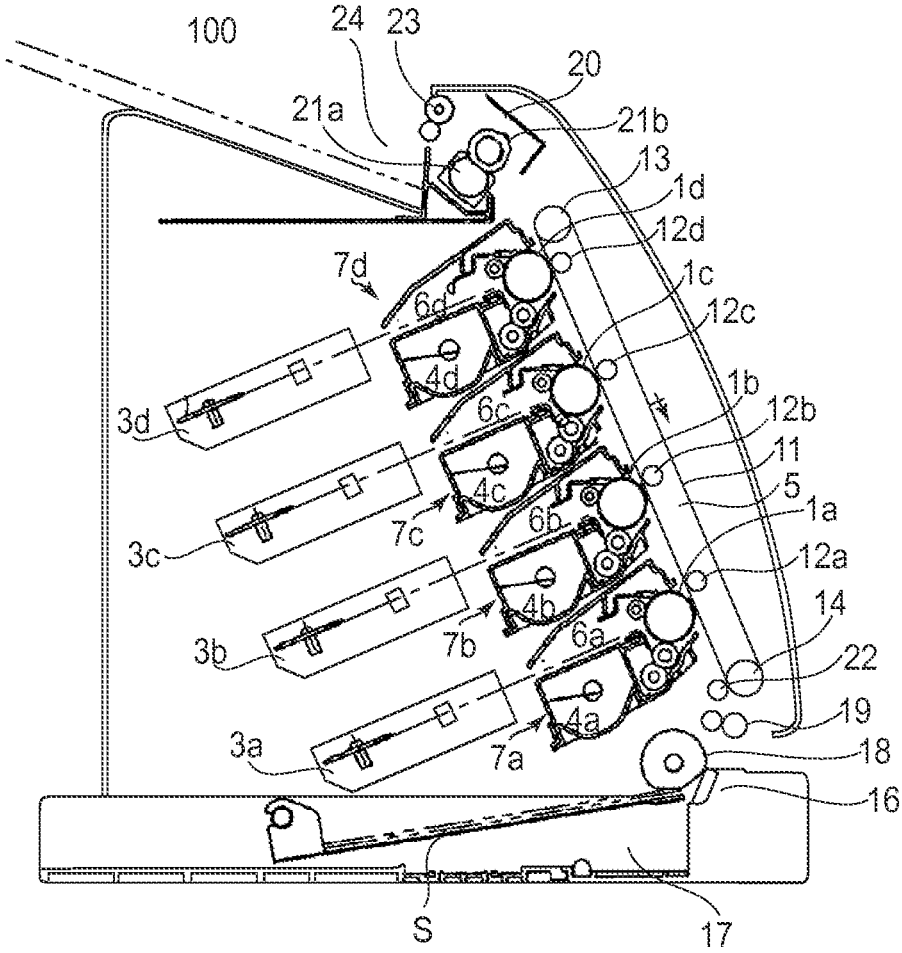
FIG. 1 is a sectional view of an example of the multicolor image forming apparatus in the first embodiment of the present invention.

First, the general structure of the multicolor image forming apparatus will be described referring to FIG. 1. FIG. 1 is a vertical sectional view of a full-color laser beam printer, which is one of the various forms of a multicolor image forming apparatus, showing the general structure thereof.

The main assembly 100 of the image forming apparatus (which hereinafter will be referred to simply as an apparatus main assembly) shown in FIG. 1 is equipped with four electrophotographic photosensitive drums 1 (1*a*, 1*b*, 1*c*, and 1*d*), which are electrophotographic photosensitive members. These electrophotographic photosensitive drums 1 (which hereinafter will be referred to as photosensitive drums 1) are in the form of a drum, and are vertically stacked parallel to each other. They are rotationally driven by a driving means (unshown) in the counterclockwise direction of the drawing. In the adjacencies of the peripheral surface of each of the photosensitive drums 1, a charging apparatus 2, a developing apparatus 4 (4*a*, 4*b*, 4*c*, and 4*d*), an electrostatic transferring apparatus 5, a cleaning apparatus (6*a*, 6*b*, 6*c*, and 6*d*) are disposed in the listed order in terms of the rotational direction of the photosensitive drum 1. The charging apparatus 2 uniformly charges the peripheral surface of the photosensitive drum 1. The developing apparatus 4 develops an electrostatic latent image formed on the peripheral surface of the photosensitive drum 1; it turns the electrostatic latent image into a toner image (image formed of toner) by adhering toner to the electrostatic latent image. The electrostatic transferring apparatus 5 transfers the toner image on the photosensitive drum 1 onto a recording medium S. The cleaning apparatus (6*a*, 6*b*, 6*c*, 6*d*) removes the toner remaining on the peripheral surface of the photosensitive drum after the transfer of the toner image.

The photosensitive drum 1, charging apparatus 2, developing apparatus 4, and cleaning apparatus (6*a*, 6*b*, 6*c*, 6*d*) are integrally disposed in a cartridge, making up a process cartridge 7 (which hereinafter will be referred to "cartridge").

In the rear portion of the apparatus main assembly, scanner units (3*a*, 3*b*, 3*c*, and 3*d*) are disposed, each of which is for selectively exposing the numerous points of the peripheral surface of the corresponding photosensitive drum 1 to form a latent image on the photosensitive drum 1.

The electrostatic transferring apparatus is provided with an electrostatic transfer belt 11, which is positioned so that it opposes all the photosensitive drums 1*a*, 1*b*, 1*c*, and 1*d*. The electrostatic transfer belt 11 circularly moves in contact with all the photosensitive drums 1*a*, 1*b*, 1*c*, and 1*d*. As the material for the electrostatic transfer belt 11, resin film, or a multilayer film made up a substrate layer formed of rubber and a resin layer layered on the substrate layer, is used. The electrostatic transfer belt 11 is stretched around a driver roller 13, a follower roller 14, and a tension roller (not shown). It is circularly moved, with the recording medium S electrostatically adhered to the outward surface (in terms of the loop which the belt 11 forms) of the electrostatic transfer belt 11, with the application of bias to an electrostatic adhesion roller 22, so that the recording medium S is placed in contact with each of the abovementioned photosensitive drums 1. Thus, the recording medium S is conveyed by the electrostatic transfer belt 11 to the transfer station, in which the toner image on the photosensitive drum 1 is transferred onto the recording medium S.

Within the loop of this electrostatic transfer belt 11, transfer rollers (12*a*, 12*b*, 12*c*, and 12*d*) are disposed in parallel, in contact with the inward surface (in terms of loop of the transfer belt), opposing the four photosensitive drums 1*a*, 1*b*, 1*c*, and 1*d*, respectively. As such bias that is opposite in polarity to the toner image is applied to each of the transfer rollers 1, the toner image on the corresponding photosensitive drum 1 is transferred onto the recording medium S.

A feeding station 16 is a portion for feeding the recording medium S into the apparatus main assembly, and conveying it to the image formation portion. The feeding station 16 and abovementioned electrostatic transfer belt 11 make up a conveying means for conveying the recording medium S. The feeding station 16 holds a feeder cassette 17, in which multiple recording media S are stored. The feeder cassette 17 is removably mounted in the feeding station 16. In an image forming operation, a feeder roller 18 (roller with semicircular cross section) and a registration roller 19 are rotationally driven in synchronism with the progression of the image forming operation. More specifically, as the feed roller 18 is rotationally driven, the recording media S in the feeder cassette 17 are fed into the main assembly while being separated one by one. Each of the recording media fed into the main assembly is conveyed by the registration roller 19 to the electrostatic transfer belt 11, in synchronism with the rotation of the electrostatic transfer belt 11, so that the arrival of the theoretical transfer start line on the recording medium S at the transfer station coincides with the arrival, at the transfer station, of the leading edge of the toner image on the photosensitive drum 1.

A fixing station 20 is a station in which the multiple toner images, different in color, having just been transferred onto the recording medium S, are fixed. It is made up of a rotatable heat roller 21*a*, and a rotatable pressure roller 21*b* which is kept pressed on the heat roller 21*a* to apply heat and pressure to the recording medium S.

To describe the image forming operation, the cartridges 7*a*, 7*b*, 7*c*, and 7*d* are sequentially driven in coordination with the printing timing, being thereby rotated in the counterclockwise direction. Further, the scanner units (3*a*, 3*b*, 3*c*, 3*d*) are rotationally driven in succession in response to the rotation of the corresponding photosensitive drums 1. As a result, an electrostatic latent image is formed on each of the photosensitive drums 1, the peripheral surface of which has been uniformly charged. The latent image is developed by the developing apparatus 4 into a toner image.

In synchronism with the progression of the formation of the toner image in each of the image forming stations, the recording medium S is sequentially conveyed by the electrostatic transfer belt 11 to each of the areas, in which the recording medium S opposes the photosensitive drum 1. As transfer bias is applied to the transfer rollers (12*a*, 12*b*, 12*c*, and 12*d*) which oppose the photosensitive drums 1, one for one, with electrostatic transfer belt 11 remaining pinched between the photosensitive drums 1 and transfer rollers (12*a*, 12*b*, 12*c*, 12*d*), the developer images, different in color, on the photosensitive drums 1 are transferred in layers onto the recording medium S. As a result, a color image is effected on the recording medium S.

The recording medium S bearing the transferred four toner images different in color is separated from the electrostatic transfer belt 11 with the utilization of the curvature of the driver roller 13, and is conveyed into the fixation station 20, in which the toner images are thermally fixed to the recording medium S. Thereafter, the recording medium S is discharged by a discharge roller 23 from the main assembly through a recording medium outlet 24, with the image bearing surface of the recording medium S facing downward.

[Cartridge Structure]

Figure 2:
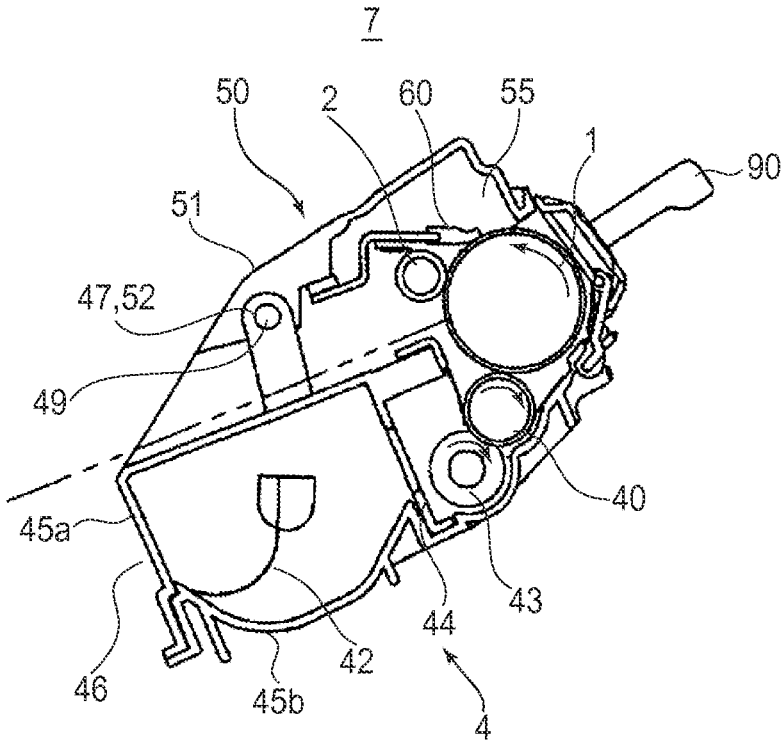
FIG. 2 is a sectional view of the cartridge in the first embodiment of the present invention.
Figure 3:
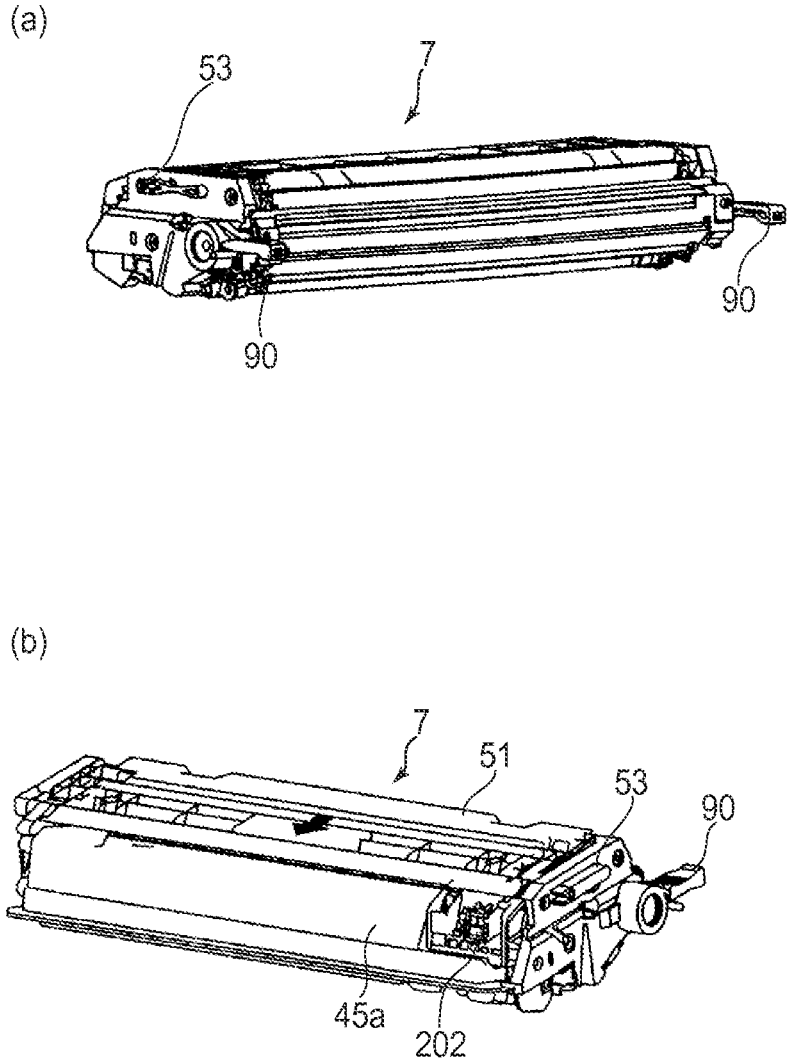
FIG. 3 is a perspective view of the cartridge in the first embodiment of the present invention.

Next, referring to FIGS. 3 and 4, the cartridge in this embodiment will be described in detail. FIGS. 2 and 3 are sectional and perspective views, respectively, of the cartridge 7 which is holding toner. Incidentally, the cartridges 7*a*, 7*b*, 7*c*, and 7*d*, which hold yellow, magenta, cyan, and black toners, respectively, are the same in structure.

Each cartridge 7 is made up of a cleaner unit 50 and a development unit 4. The cleaner unit 50 comprises: the photosensitive drum 1, charging means, and cleaning means. The development unit 4 makes up the developing apparatus for developing an electrostatic latent image on the photosensitive drum 1.

The cleaner unit 50 has a cleaning unit frame 51, to which the photosensitive drum 1 is rotatably attached, with the bearings placed between the photosensitive drum 1 and cleaning unit frame 51. In the adjacencies of the peripheral surface of the photosensitive drum 1, a primary charging apparatus 2 is disposed, which is for uniformly charging the photosensitive layer as the surface layer of the photosensitive drum 1. Also in the adjacencies of the peripheral surface of the photosensitive drum 1, a cleaning blade 60 (which hereinafter will be referred to as "blade") is disposed, which is for removing the developer (residual toner) remaining on the peripheral surface of the photosensitive drum 1 after the image transfer. The residual toner removed from the peripheral surface of the photosensitive drum 1 by the blade 60 is stored in a residual toner bin 55 located above the blade 60.

The development unit 4 is made up of: a development sleeve 40 which rotates in the direction indicated by an arrow mark while maintaining a minute gap from the photosensitive drum 1; and development unit frames 45*a* and 45*b* in which toner is held.

The development unit frames 45*a* and 45*b* are joined with each other (welded to each other by ultrasonic welding or the like), making up a developing means container unit 46.

The development sleeve 40 is rotatably supported by a developing means container unit 46 with the placement of bearings between the development sleeve 40 and the unit 46. In the adjacencies of the development sleeve 40, a toner supply roller 43 and a development blade 44 are disposed in contact with the development sleeve 40. The toner supply roller 43 is rotated in the direction indicated by an arrow mark. Further, within the developing means container unit 46, a toner conveyance mechanism 42, which is for conveying the toner in the developing means container unit 46 to the toner supply roller 43 while stirring the toner is disposed.

As for the sequence in which the development unit 40 is assembled, first, the developing means unit 46 and cleaner unit 50 are positioned so that a pair of connective holes 47 with which the lengthwise ends of the unit 46 is provided one for one, align with the supporting holes 52 with which the lengthwise ends of the cleaner unit frame 51, one for one. Then, a pin 49 is inserted through the connective hole 47 and supporting hole 52, at both lengthwise ends of the development unit 4, effecting thereby the cartridge 7 structured so that the development unit 4 is suspended from the cleaner unit 50, and also, so that the development unit 4 is allowed to pivotally move relative to the cleaner unit 50.

Further, the development unit 4 is kept pressed toward the cleaner unit 50 by compression springs (unshown) so that even if the developing unit 4 pivots about the axial lines of the supporting holes 52, the development sleeve 40 remains in contact with the peripheral surface of the photosensitive drum 1.

[Structure for Mounting Cartridge into Apparatus Main Assembly]

Next, referring to FIG. 4, the portion of the apparatus main assembly 100, into which the cartridges 7 are mounted, will be described (this portion hereafter will be referred to as "cartridge bay"). As shown in FIG. 4, the apparatus main assembly 100 is provided with a front door 101, which is rotatably attached to the apparatus main assembly 100. Behind the front door 101, the electrostatic transferring apparatus 5 is rotatably disposed. It is when the front door 101 and electrostatic transferring apparatus 5 are in the open position that the cartridges 7 are removably mountable in the apparatus main assembly 100. The cartridge 7 is provided with a pair of handgrips 90, which are located at the lengthwise ends of the cartridge 7, near the photosensitive drum supporting portions of the cartridge 7. When the cartridge 7 is mounted or removed, the handgrips 90 are protruding toward the front door 101.

The lengthwise end surfaces of the cartridge 7 are provided with a pair of insert guides 53 (FIG. 3 as well as FIG. 4), one for one, which engage with a pair of guide rails 102 and 103, one for one, located in the apparatus main assembly 100, enabling the cartridge 7 to be mounted into, or removed from the apparatus main assembly 100.

As a user finishes mounting the cartridge 7 and closes the front door 101, the closure of the front door 101 applies pressure (unshown) to the cartridge 7. Then, the cartridge 7 is properly positioned relative to the apparatus main assembly 100 by the driving force transmitted to the cartridge 7 to form an image.

[Memory]

Figure 7:
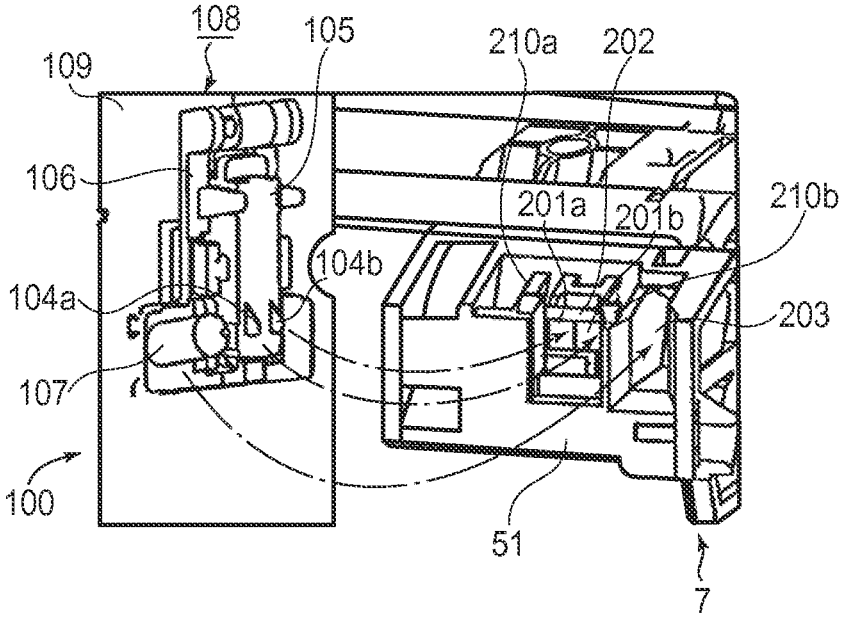
FIG. 7 is a perspective view of the memory, and the electrical contacts of the main assembly, in the first embodiment of the present invention.

The cartridge 7 in this embodiment is provided with a memory 200 for storing such information as the lot number of the cartridge 7, the characteristics of an image forming apparatus, the characteristics of the processing means, etc. Next, referring to FIGS. 3, 5, and 7, this memory will be described. Incidentally, FIG. 5 is a perspective view of the memory itself, and FIG. 7 is a perspective view of the electrical contacts, and their adjacencies, in the apparatus main assembly 100.

The cartridge 7 in this embodiment sends the information in the memory 200 to the apparatus main assembly 100, providing the control portion (unshown) of the apparatus main assembly 100 with the information regarding the cartridge 7, such as the history of the usage of the cartridge 7, according to which the control portion controls the image forming process. It also receives information from the apparatus main assembly 100. Therefore, images are formed under optimal conditions.

Figure 5:
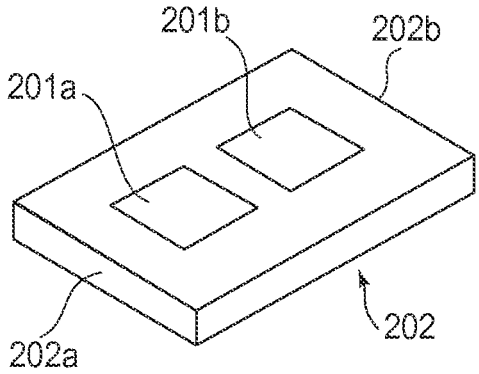
FIG. 5 is a perspective view of the memory itself in the first embodiment of the present invention.
Figure 5:
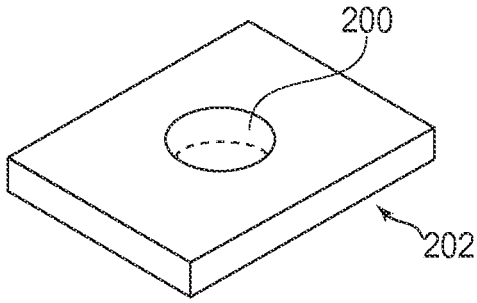

Referring to FIG. 5, the memory 200 in this embodiment is attached to one of the primary surfaces of the memory substrate 202, which is a thin and rectangular member. The memory substrate 202 is provided with a pair of electrical contacts 201*a* and 201*b*, which are on the opposite surface from the surface having the memory 200. In other words, the memory substrate 202 also serves as an electrical contact substrate. The memory substrate 202 is attached to a contact supporting means, with which the cleaner unit 50 is provided. The contact supporting means will be described later.

As the cartridge 7 is mounted into the apparatus main assembly 100, the electrical contacts 201*a* and 201*b* of the cartridge 7 are placed in contact with a pair of electrical contacts 104*a* and 104*b*, respectively, of the apparatus main assembly 100, establishing an electrical connection between the cartridge 7 and apparatus main assembly 100, enabling the information in the memory 200 to be transmitted to the apparatus main assembly 100 through the electrical contacts 104*a* and 104*b*.

The memory substrate 202 is attached to the cleaner unit frame 51 so that the electrical contacts 201*a* and 201*b* of the cartridge 7 face outward of the cartridge 7. The memory substrate 202 is attached to the cleaner unit frame 51 so that as the cartridge 7 is inserted into the apparatus main assembly 100, the electrical contacts 201*a* and 201*b* of the cartridge 7 face roughly downstream, in terms of the direction in which the cartridge 7 is inserted into the apparatus main assembly 100.

Further, in this embodiment, the cleaner unit 50, which holds the memory substrate 202, is provided with a groove 203 for accurately positioning the electrical contacts. The groove 203 is located next to the electrical contacts 201*a* and 201*b* of the cartridge 7, in terms of the lengthwise direction of the cleaning means unit 50. This groove 203 functions as an electrical contact positioning portion (which hereinafter may be referred to as contact positioning groove). More specifically, as the cartridge 7 is mounted into the apparatus main assembly 100, the positioning portion, with which the apparatus main assembly 100 is provided to properly position the electrical contacts 201*a* and 201*b* relative to the electrical contacts 104*a* and 104*b*, respectively, of the apparatus main assembly 100, engage into the contact positioning groove 203.

[Structure for Attaching or Removing Memory]

Figure 8:
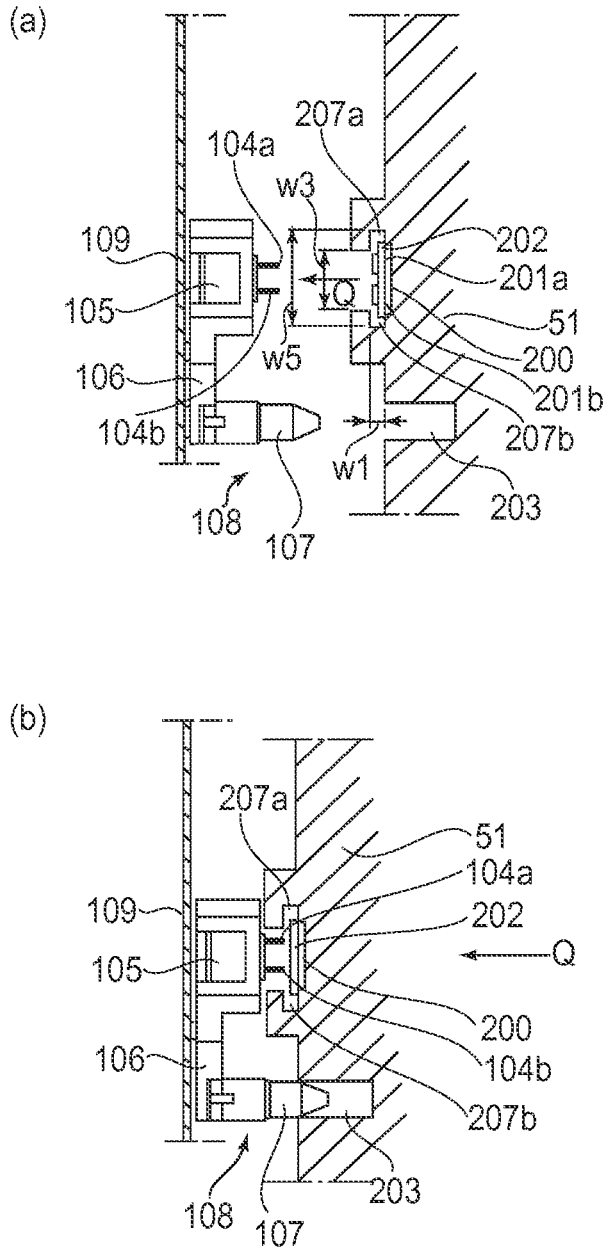
FIG. 8 is a sectional view of the memory, and the electrical contacts of the main assembly, in the first embodiment, showing their positioning relative to each other in terms of the lengthwise direction of the electrical contacts of the main assembly.

Next, referring to FIGS. 6-8, the structure for attaching the memory substrate 202 to the cartridge 7, and removing the memory substrate 202 from the cartridge 7, will be described.

Figure 6:
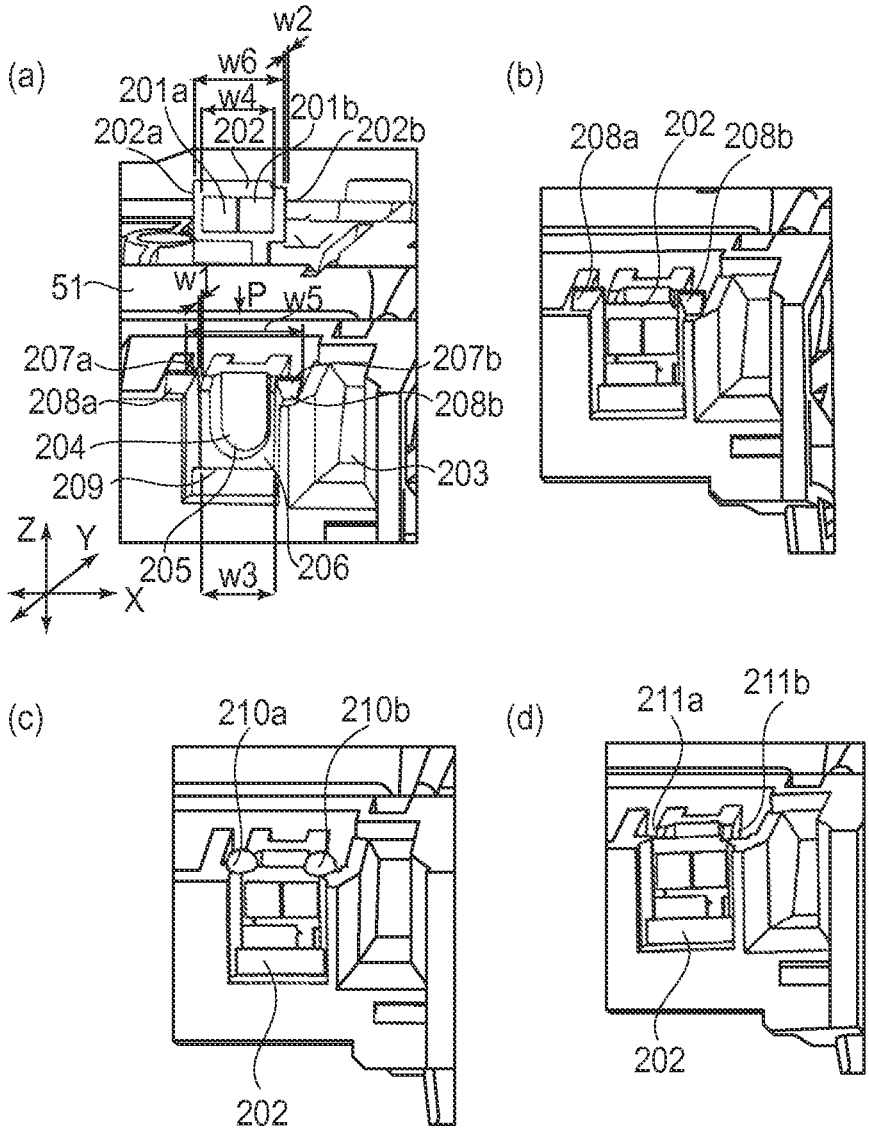
FIG. 6 is a perspective view of the memory, and the memory slot portion of the main assembly of the image forming apparatus, in the first embodiment, showing the method for attaching the memory and the method for removing the memory.

FIGS. 6(*a*)-6(*d*) are perspective views of the memory 202, and the memory slots of the cartridge 7, sequentially showing the steps of the method for attaching the memory substrate 202 to the cartridge 7, and the steps of the method for removing the memory substrate 202 from the cartridge 7. FIGS. 8(*a*) and 8(*b*) are sectional views of the memory portion of the cartridge 7 and the electrical contact unit of the main assembly 100, at a plane parallel to the lengthwise direction of the process cartridge 7, showing their states prior to, and after, the final step of the mounting of the cartridge 7 into the apparatus main assembly 100.

Referring to FIG. 6(*a*), the lengthwise direction of the drum, which is the same as the direction (indicated by arrow mark X) of the rotational axis of the photosensitive drum 1, is referred to as the width direction of the memory substrate 202. Further, the direction (indicated by arrow mark Y) in which the cartridge 7 is inserted into, or removed from, the apparatus main assembly 100, that is, the direction perpendicular to the above described width direction of the memory substrate 202, is referred to as the thickness direction of the memory substrate 202. Further, the direction (indicated by arrow mark Z) perpendicular to the above described width and thickness directions of the memory substrate 202 is referred to as the height direction of the memory substrate 202.

The cleaner unit frame 51 is provided with a contact supporting means 204 for supporting the memory substrate 202, and the memory supporting means 204 is provided with a recess 205, which is for accommodating the memory 200 attached to one of the primary surfaces of the memory substrate 202. The memory accommodating recess 205 is located roughly in the center of the contact supporting means 204. In the adjacencies of the memory accommodating recess 205, a surface 206 is provided, which is for taking the pressure that bears on the memory substrate 202 as the electrical contacts 201*a* and 201*b* of the cartridge 7 are placed in contact with the electrical contacts 104*a* and 104*b*, respectively, in order to regulate the movement of the memory substrate 202 in the thickness direction, which might be caused by the abovementioned pressure.

Further, there are a pair of regulating members 220*a* and 220*b* on the outward side of the pressure taking surface 206 in terms of the lengthwise direction of the photosensitive drum 1. The regulating members 220*a* and 220*b* are L-shaped in cross section, and are integral parts of the cleaner unit frame 51 (FIG. 8: sectional view). With the provision of the above described portions and members, a pair of slits 207*a* and 207*b* are effected, which sandwich the pressure taking surface 206. These slits 207*a* and 207*b* constitute the contact supporting means in this embodiment. The slits 207*a* and 207*b* have openings 211*a* and 211*b*, respectively, which are on the top side of the slits 207*a* and 207*b* in terms of the height direction of the memory substrate 202.

As for the method for attaching the memory substrate 202 to the cartridge 7, the edge portions 202*a* and 202*b* of the memory substrate 202, which are on the opposite sides of the combination of the electrical contacts 201*a* and 201*b* of the cartridge 7, are to be engaged into the slits 207*a* and 207*b*, through the openings 211*a* and 211*b* of the slits 207*a* and 207*b*, respectively. In this embodiment, the memory substrate 202 is rectangular. However, the design of the structure for engaging the memory substrate 202 into the slits 207*a* and 207*b* is not limited by the shape of the memory substrate 202. That is, all that is necessary is that the edge portions 202*a* and 202*b* of the memory substrate 202, which are on the opposite sides of the combination of the electrical contacts 201*a* and 201*b* of the cartridge 7, can be engaged one for one into the pair of slits 207*a* and 207*b* of the cleaner unit frame 51.

As the memory substrate 202 is inserted into the slits 207*a* and 207*b* as described above, the movement of the memory substrate 202 in the width direction is regulated by a first regulating portion, which has a preset amount of gap, whereas the movement of the memory substrate 202 in the thickness direction is a second regulating portion, which has a preset amount of gap.

More specifically, the first regulating portion is made up of a pair of surfaces opposing each other, with the presence of the preset amount of gap, in terms of the width direction of the memory substrate 202, that is, the inwardly facing surface of the regulating member 220*a* and the inwardly facing surface of the regulating member 220*b*, in terms of the width direction of the memory substrate 202. The second regulating portion is made up of the pressure taking surface 206, the surface of the regulating member 220*a*, which opposes the pressure taking surface 206, with the presence of the preset amount of gap, in terms of the thickness direction of the memory substrate 202, and the surface of the regulating member 220*b*, which opposes the pressure taking surface 206, with the presence of the preset amount of gap, in terms of the thickness direction of the memory substrate.

With the provision of the above described structural arrangement, as the memory substrate 202 is inserted into the slits 207*a* and 207*b*, the movement of the memory substrate 202 in the width direction of the memory substrate 202 is regulated by the inwardly facing surface of the regulating member 220*a* and the inwardly facing surface of the regulating member 220*b*, which face each other in terms of the width direction of the memory substrate 202, whereas the movement of the memory substrate 202 in the thickness direction of the memory substrate 202 is regulated by the pressure taking surface 206, and the surface of the regulating member 220*a*, which opposes the pressure taking surface 206, with the presence of the preset amount of gap, in terms of the thickness direction of the memory substrate 202, and the surface of the regulating member 220*b*, which opposes the pressure taking surface 206, with the presence of the preset amount of gap, in terms of the thickness direction of the memory substrate.

Here, the gap of the second regulating portion, that is, the distance W1 between the pressure taking surface 206, and the surface of the regulating member 220*a* (220*b*) which opposes the pressure taking surface 206 in terms of the thickness direction of the memory substrate 202, is rendered slightly greater than the dimension W2 of the memory substrate 202 in terms of the thickness direction of the memory substrate 202 (W1>W2). The gap of the first regulating portion, that is, the distance W5 between the inward surfaces of the regulating members 220*a* and 220*b*, which oppose each other in terms of the width direction of the memory substrate 202, is rendered slight greater than the dimension W6 of the memory substrate 202 in terms of the width direction of the memory substrate 202. Therefore, the memory substrate 202 can be easily (without substantial amount of physical resistance) inserted into the slits 207*a* and 207*b*.

As for the relationship between the gap W1 of the second regulating portion and the thickness W2 of the memory substrate 202, it is such that it satisfies the following inequalities: W2<W1, and (W1−W2)<U. Here, "U" represents the amount of stroke of the electrical contact 104*a* (104*b*).

That is, the amount of play that the memory substrate 202 is afforded in terms of the thickness direction Y of the memory substrate 202 is no less than zero, ensuring that the memory substrate 202 comes into contact with the pressure taking surface 206, within the range of the stroke of the electrical contacts 104*a* and 104*b* of the apparatus main assembly 100.

The position of the pressure taking surface 206 is set so that the gap W1 of the second regulating portion, that is, the distance between the pressure taking surface 206, and the surface of the regulating member 220*a* (220*b*), which opposes the pressure taking surface 206, can ensure that as the memory substrate 202 is inserted into the slits 207*a* and 207*b*, an electrical connection is established between the electrical contacts 201*a* and 201*b* of the cartridge 7 and the electrical contacts 104*a* and 104*b* of the apparatus main assembly 100 by the contact pressure generated as the memory substrate 202 comes into contact with the pressure taking surface 206.

The gap between the abovementioned pair of regulating members 220*a* and 220*b* constitutes the gap through which the electrical contacts 201*a* and 201*b* of the cartridge 7 remain unobstructedly exposed after the memory substrate 202 is properly inserted into the slits 207*a* and 207*b*. In terms of the width direction of the memory substrate 202, the dimension W3 of the exposure gap is set so that it is greater than dimension W4 of the combination of the electrical contacts 201*a* and 201*b* of the cartridge 7 on the memory substrate 202.

Here, the relationship among the dimensions W3, W4, W5, and W6 is: W3>W4; W5>W6; and (W3−W4)>(W5−W6).

In other words, the play, in the width direction X of the memory substrate 202, afforded for the memory substrate 202 is set so that it is no less than zero, and also, so that even if the memory substrate 202 is displaced in its width direction X, the electrical contacts 201*a* and 202*b* of the cartridge 7 are not covered by the regulating members 220*a* and 220*b*, respectively.

Further, there are a pair of projections 208*a* and 208*b*, which are located next to the abovementioned openings 211*a* and 211*b* of the slits 207*a* and 207*b*, respectively; in other words, the projections 208*a* and 208*b* are located next to the top portions of the slits 207*a* and 207*b*, respectively. When attaching the memory substrate 202 to the cleaner unit frame 51, the memory substrate 202 is to be inserted from the direction indicated by an arrow mark P in FIG. 6(*a*) until the memory substrate 202 strikes the top surface of a projection 209 (FIG. 6(*b*)) located at the bottom end of each of the slits 207*a* and 207*b*. Thereafter, the abovementioned projections 208*a* and 208*b* located next to the top ends of the slits 207*a* and 207*b* are to be melted by the direct application of heat, application of ultrasonic waves, or the like method, from the direction P, so that the openings of the slits 207*a* and 207*b* are covered (FIG. 6(*c*)). In other words, the projections 208*a* and 208*b* are turned into a pair of memory substrate retaining portions 210*a* and 210*b* for preventing the memory substrate 202 from slipping out of the slits 207*a* and 208*a*. Thus, once the memory substrate 202 is attached to the cleaner unit frame 51 using the above described structural arrangement and method, it will not disengage from the cleaner unit frame 51.

Incidentally, in this embodiment, the memory substrate 202 is prevented from disengaging from the cartridge 7, by melting of the projections 208*a* and 208*b*. However, the method for preventing the disengagement of the memory substrate 202 does not need to be limited to the above described method. For example, the downstream end portion of each of the slits 207*a* and 207*b*, in terms of the direction in which the memory substrate 202 is inserted, may be provided with such a projection that renders the dimension of the corresponding portion of each of the slits 207*a* and 207*b*, in terms of the width direction of the memory substrate 202, slightly less than the width of the memory substrate 202. In the case of this design, a small amount of pressure has to be applied to the memory substrate 202 to insert the memory substrate 202 into the slits 207*a* and 207*b*. However, this design requires no other step to be taken after the insertion of the memory substrate 202; the memory substrate 202 is prevented by the projections from coming out of the slits 207*a* and 207*b*.

In this embodiment, after the attachment of the memory substrate 202 to the cleaner unit frame 51, the electrical contacts 201*a* and 201*b* of the cartridge 7 are between the edge portions 202*a* and 202*b* of the memory substrate 202, which are inserted 207*a* and 207*b*. Therefore, the electrical contacts 201*a* and 201*b* of the cartridge 7 are recessed from the surface of the cleaner unit frame 51, which surrounds electrical contacts 201*a* and 201*b*. Therefore, a user is prevented from touching the electrical contacts 201*a* and 201*b* of the cartridge 7 when the user is handling the cartridge 7.

Next, the removal of the memory substrate 202, which occurs when recycling the cartridge 7, will be described. The method for removing the memory substrate 202 from the cartridge 7 is as follows: First, the memory substrate retaining portions 210*a* and 210*b* created by melting the projections 208*a* and 208*b* are to be cut away with the use of such a tool as a nipper, to expose the openings 211*a* and 211*b* of the slits 207*a* and 207*b*, respectively. With the openings 211*a* and 211*b* exposed, the memory substrate 202 can be easily removed. As for the method for attaching a brand-new substrate 202 to a recycled cartridge 7, first, the brand-new substrate 202 is to be inserted into the slits 207*a* and 207*b*. Then, the slits 207*a* and 207*b* are to be directly welded shut, or are shut by welding additional members to the top ends of the slits 207*a* and 207*b*, to prevent the memory substrate 202 from slipping out of the slits 207*a* and 207*b*. With the employment of the above described recycling method, the cartridge 7 can be repeatedly recycled.

[Structure for Keeping Connected Electrical Contacts of Cartridge and Electrical Contact of Apparatus Main Assembly]

Next, referring to FIG. 7, the structure for connecting and keeping connected the electrical contacts 201*a* and 201*b* of the memory 200 of the cartridge and the electrical contacts 104*a* and 104*b* of the apparatus main assembly 100 will be described.

As described above, the cartridge 7 is provided with the memory substrate 202, which is attached to the cleaner unit frame 51, which is on the back side of the cartridge 7. The main assembly 100 is also provided with a contact supporting portion 105 for supporting the electrical contacts 104*a* and 104*b* of the apparatus main assembly 100, and a supporting member 106 for supporting the contact supporting portions 105. The contact supporting portion 105 and contact supporting portion supporting member 106 are integral parts of a contact unit 108, which is attached to a main assembly frame 109, being enabled to move only in the length direction of the drum (width direction of memory circuit board).

Figure 4:
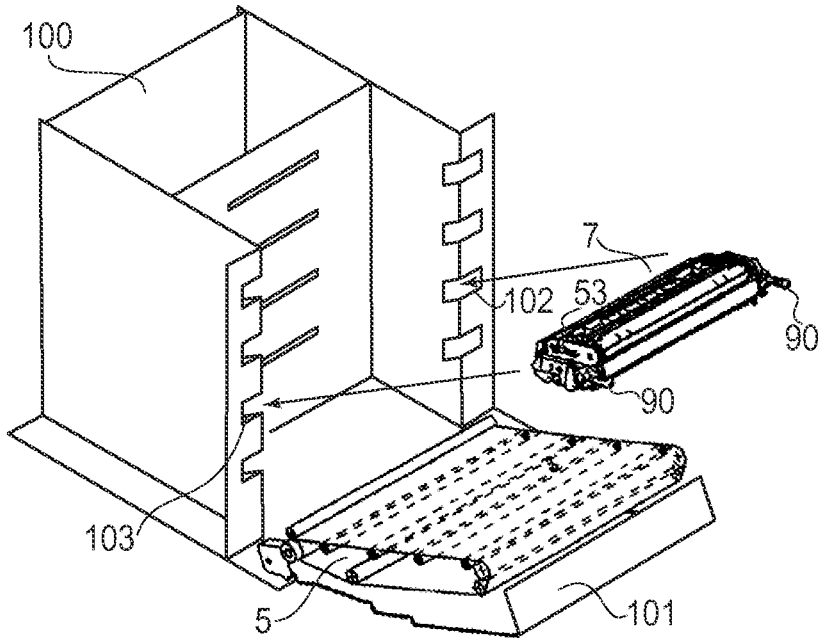
FIG. 4 is a schematic perspective view of the process cartridge, and the process cartridge bay of the main assembly of the image forming apparatus, in the first embodiment, showing how the process cartridge is mounted into the process cartridge bay.

The cartridge 7 is to be inserted rear side first (FIG. 4) into the cartridge bay of the apparatus main assembly 100 (FIG. 4). As described above, the cartridge 7 is provided with the contact positioning groove 203 as the cartridge positioning portion on the cartridge 7 side. Further, the abovementioned supporting member 106 of the apparatus main assembly 100 is provided with a positioning boss 107 also as a cartridge positioning member. Thus, as the cartridge 7 is inserted into the apparatus main assembly 100, the contact positioning grooves 203 of the cartridge 7 engage with the positioning bosses 107 of the supporting member 106, before the cartridge 7 reaches a preset position in the apparatus main assembly 100. As a result, the contact unit 108 is accurately positioned relative to the cartridge 7.

Thereafter, the electrical contacts 201*a* and 201*b* of the cartridge, with which the memory substrate 202 is provided, come into contact with the electrical contacts 104*a* and 104*b* of the apparatus main assembly 100, establishing thereby electrical contact between the cartridge 7 and apparatus main assembly 100.

Consequently, it becomes possible for electrical information to be exchanged between the memory 200 and the control circuit portion (unshown) of the apparatus main assembly 100. Incidentally, for the reliability in electrical connection, the electrical contacts 201*a* and 201*b* of the cartridge 7, and the electrical contacts 104*a* and 104*b* of the apparatus main assembly 100, are plated with gold. More specifically, in this embodiment, the electrical contacts 104*a* and 104*b* of the apparatus main assembly 100, and the electrical contacts 201*a* and 201*b* of the cartridge 7, are formed of copper, and are plated with gold.

Regarding the engagement between the positioning boss 107 and contact positioning groove 203, it does not need to be perfect. That is, it may be loose enough for the cartridge 7 to be easily inserted, as long as it is not too loose for accurate positioning of the cartridge 7. It should be noted here that in terms of the height direction Z of the memory substrate 202, the engagement between the positioning boss 107 and contact positioning groove 203 does not fix the positional relationship between the cartridge 7 and apparatus main assembly 100; in other words, the cartridge 7 is allowed to move in the height direction Z of the memory substrate 202 even after the engagement between the positioning bosses 107 and contact positioning grooves 203. In other words, in terms of the height direction (indicated by arrow mark Z in FIG. 6(*a*)), the contact unit 108 and the cartridge 7 are separately positioned relative to the frame 109 of the apparatus main assembly 100.

At this time, referring to FIG. 8, the steps in the process for mounting the cartridge 7 into the apparatus main assembly 100 will be described as seen from an angle different from the angle from which they were seen in FIGS. 6 and 7. As a user moves the cartridge 7 in the cartridge insertion direction (indicated by arrow mark Q in FIG. 8(*a*)), the tip portion of the positioning boss 107 enters the contact positioning groove 203 of the cleaner unit frame 51 (FIG. 8(*b*)). Then, as the cartridge 7 is further inserted, the positioning boss 107 fully engages with the contact positioning groove 203, and thereafter, the electrical contacts 201*a* and 201*b* of the cartridge 7 come into contact with the electrical contacts 104*a* and 104*b* of the apparatus main assembly 100, respectively.

The tip portion of the positioning boss 107 is tapered to ensure that the positioning boss 107 is guided into the contact positioning groove 203, even if the cartridge 7 is deviated in position in terms of the lengthwise direction of the photosensitive drum 1 while it is mounted into the apparatus main assembly 100. With the employment of the above described structural arrangement, it is ensured that as the cartridge 7 is mounted into the apparatus main assembly 100, the axial line of the positioning boss 107 falls within the contact positioning groove 203. Therefore, even if a certain amount of play is present, as described above, between the memory substrate 202 and the walls of the memory substrate slot of the apparatus main assembly 100, in terms of the lengthwise direction of the photosensitive drum 1, the contact unit 103 is accurately positioned relative to the memory substrate 202, in terms of the lengthwise direction of the photosensitive drum 1, directly by the positioning boss 107 and contact positioning groove 203, in the immediate adjacencies of the memory substrate 202. Therefore, it is assured that an electrical connection is established between the electrical contacts 104*a* and 104*b* of the apparatus main assembly 100 and the electrical contacts 201*a* and 201*b* of the cartridge 7, respectively.

Next, referring to FIG. 9, the positioning of the memory substrate 202 in terms of its thickness direction will be described. As described above, a certain amount of play is provided between the memory substrate 202 and the walls of the slits 207 (207*a* and 207*b*). Therefore, in terms of the thickness direction of the memory substrate 202, the memory substrate 202 may be in any place in the slits 207.

Figure 9:
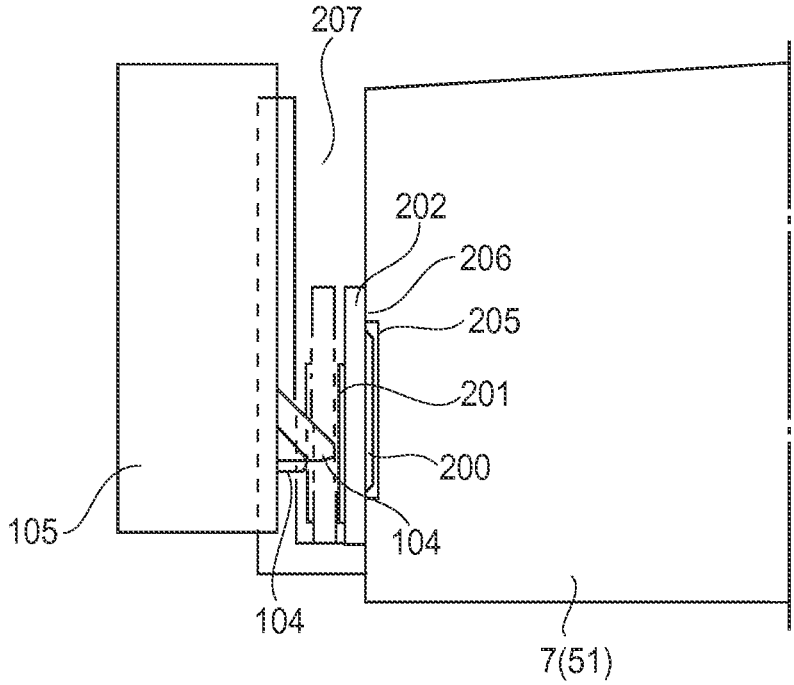
FIG. 9 is a sectional view of the electrical contacts of the main assembly, and the electrical contacts of the cartridge, in the first embodiment, which are in the properly connected state.

The electrical contacts 104 (104*a* and 104*b*) of the apparatus main assembly 100 are formed of an elastic substance, and are in the form of a spring, projecting from the contact supporting portion 105 (indicated by solid line in FIG. 9). Thus, as the cartridge 7 is inserted to a preset point in the apparatus main assembly 100, the electrical contacts 104 of the apparatus main assembly 100 are pressed into the contact supporting portion 105 as shown by the broken line in FIG. 9. In other words, the contact points of the electrical contacts 104 of the apparatus main assembly 100 are allowed to move a preset distance in the cartridge insertion direction. Therefore, as the cartridge 7 is mounted into the apparatus main assembly 100, the electrical contacts 104 of the apparatus main assembly 100 and the electrical contacts 201 (201*a* and 201*b*) of the cartridge 7 come into contact with each other, and then, are kept pressed against each other.

That is, the electrical contacts 104 of the apparatus main assembly 100 flex a preset amount. As a result, the memory substrate 202 is pressed upon the pressure taking surface 206 of the cartridge 7 by the resiliency of the electrical contacts 104 of the apparatus main assembly 100 (electrical contacts 104 change in shape from the one drawn with a broken line to the one drawn by a solid line). Consequently, the memory substrate 202 becomes fixed in terms of its position in the slits 207, and also, the electrical contacts 104 of the apparatus main assembly 100 and the electrical contacts 201 of the cartridge 7 are kept pressed upon each other, ensuring that the electrical connection is maintained between the cartridge 7 and apparatus main assembly 100.

Further, as the electrical contacts 104 of the apparatus main assembly 100 come into contact with the electrical contacts of the cartridge 7, the points of contact of the electrical contacts 104 of the apparatus main assembly 100 move relative to the electrical contacts 201 of the cartridge 7, causing thereby the electrical contacts 104 of the apparatus main assembly and the electrical contacts 201 of the cartridge 7 to wipe each other. Therefore, even if dust or the like adheres to the electrical contacts, it is removed by the wiping, ensuing that the electrical contacts 104 and electrical contact 201 are placed, and remain, perfectly in contact with each other.

Here, as the wiping occurs, the electrical contacts 201 of the cartridge 7 and electrical contacts 104 of the apparatus main assembly 100 rub against each other. However, the number of opportunities for the electrical contacts 201 and electrical contacts 104 to rub against each other equals the number of times the cartridge 7 is replaced. Further, the number of times the cartridge 7 is replaced is very small compared to the total number of copies made during the life of apparatus main assembly 100. Therefore, it does not occur that the electrical contacts 104 of the apparatus main assembly 100 are shaved through the normal replacement of the cartridge 7; they are simply wiped.

After the proper mounting of the cartridge 7 into the apparatus main assembly 100, the supporting member 105 is integrally held to the cleaner unit 50 in terms of the lengthwise direction of the photosensitive drum 1. Thus, if the cartridge 7 shifts in its lengthwise direction in the apparatus main assembly 100, the supporting member 106 moves with the cleaner unit frame 51. Referring to FIG. 7, the electrical contacts 104 of the apparatus main assembly 100 are in the form of a leaf spring. Therefore, if the electrical contacts 104 are subjected to such force that acts in the lengthwise direction of the photosensitive drum 1, it is possible that the electrical contacts 104 will break. However, the supporting member 106 in this embodiment moves with the cleaner unit frame 51. Therefore, the electrical contacts 104*a* and 104*b* of the apparatus main assembly 100 and the electrical contacts 201*a* and 201*b* of the cartridge 7 are prevented from rubbing against each other.

As described above, the cartridge 7 in this embodiment is provided with the pair of slits, which are open at one end; the cleaner unit frame 51 of the cartridge 7 is provided with the pair of slits. The memory substrate 202 is held to the cartridge 7 (cleaning frame 51), by inserting the memory substrate 202 into the pair of slits so that the pair of opposing edge portions of the memory substrate 202, between which the electrical contacts 201*a* and 201*b* are located, are inserted into the pair of slits, one for one. In other words, the memory substrate 202 can be attached to the cartridge 7 with the use of a very simple method. Further, as the contact supporting member is inserted through the contact supporting member through its opening, the movement of the contact supporting member is regulated by the first and second regulating portions, making it also very simply to attach the contact supporting member.

Further, the electrical contacts 201*a* and 201*b* of the memory substrate 202, or the electrical contacts on the cartridge side, are disposed on the area which is recessed from the portion of the cartridge frame surface, which surrounds the area. Therefore, the electrical contacts 201*a* and 201*b* are not likely to be touched by user's fingers or the like, eliminating one of the causes of the failure in electrical connection.

Further, the gap of each slit, in which the memory substrate 202 is inserted, is rendered slightly greater than the thickness of the memory substrate 202, and the positioning of the memory substrate 202 in terms of the thickness direction of the memory substrate 202 is accomplished by the resiliency of the electrical contacts 104*a* and 104*b* of the apparatus main assembly 100, which are in the form of a leaf spring. Therefore, the memory substrate 202 can be easily inserted into the slits 207*a* and 207*b*, improving the cartridge 7 in assembly efficiency.

Further, in terms of the width direction of the memory substrate 202, such an amount of play that does not allow the regulating members 220*a* and 220*b* for supporting the memory substrate 202, to cover the electrical contacts 201*a* and 201*b* of the cartridge 7 is provided between the memory substrate 202 and the regulating members 201*a* and 201*b*, thereby improving the memory substrate 202 in assembly efficiency.

Further, after the insertion of the memory substrate 202 into the slits 207*a* and 207*b*, the opening portions of the slits 207*a* and 207*b* can be filled in to prevent the memory substrate 202 from slipping out of the slits 207*a* and 207*b*. That is, the memory substrate 202 can be attached to the cartridge 7 with the use of a simple method. Further, the direction in which the memory substrate 202 is inserted into the slits 207*a* and 207*b* is the same as the direction (in this embodiment, from top side of slits) from which the opening portions of the slits are filled, thereby improving the assembly efficiency.

Further, regarding the recycling of the cartridge 7, the memory substrate 202 can be easily removed by cutting off the retainer portions, that is, the portions filling the top ends of the slits 207*a* and 207*b*, and the memory substrate 202 can be firmly fixed to the cartridge 7 by refilling the openings created by the cutting of the retainer portions. In other words, this embodiment makes it possible to recycle the cartridge 7 through a simple process, improving the cartridge 7 in terms of recycle efficiency.

Further, in this embodiment, the memory substrate 202 is attached to the cartridge 7 by being inserted into the slits 207*a* and 207*b*. The electrical contacts 201*a* and 201*b* of the cartridge 7 are placed on one of the primary surfaces of the memory substrate 202, whereas the memory 200 is placed on the other primary surface. Therefore, not only is this embodiment effective to reduce the memory substrate 202 in size, but also, it makes it possible to easily attach to the cartridge 7 even a substrate (202), the primary surfaces of which have protrusions, being therefore not flat enough for two-sided adhesive tape, adhesive, or the like, to be properly applied.

Further, it is in the adjacencies of the memory substrate 202 that the unit which supports the electrical contacts 104*a* and 104*b* of the apparatus main assembly 100 is accurately positioned directly relative to the cartridge frame in terms of at least the lengthwise direction of the photosensitive drum 1. Therefore, the play of the memory substrate 202 can be increased relative to the walls of the slits 207*a* and 207*b*, to further improve the cartridge 7 in assembly efficiency.

Further, the memory substrate 202 is designed so that the opposing two edge portions of the memory substrate 202 are to be inserted into the slits one for one, and also, so that the electrical contacts 201*a* and 201*b* of the cartridge 7 are placed on the portions of the memory substrate 202, which are not the portions to be inserted into the slits. Therefore, the electrical contacts can be reduced in contact area to reduce the amount of gold used for plating the electrical contacts, that is, a highly costly substance.

Embodiment 2

Figure 10:
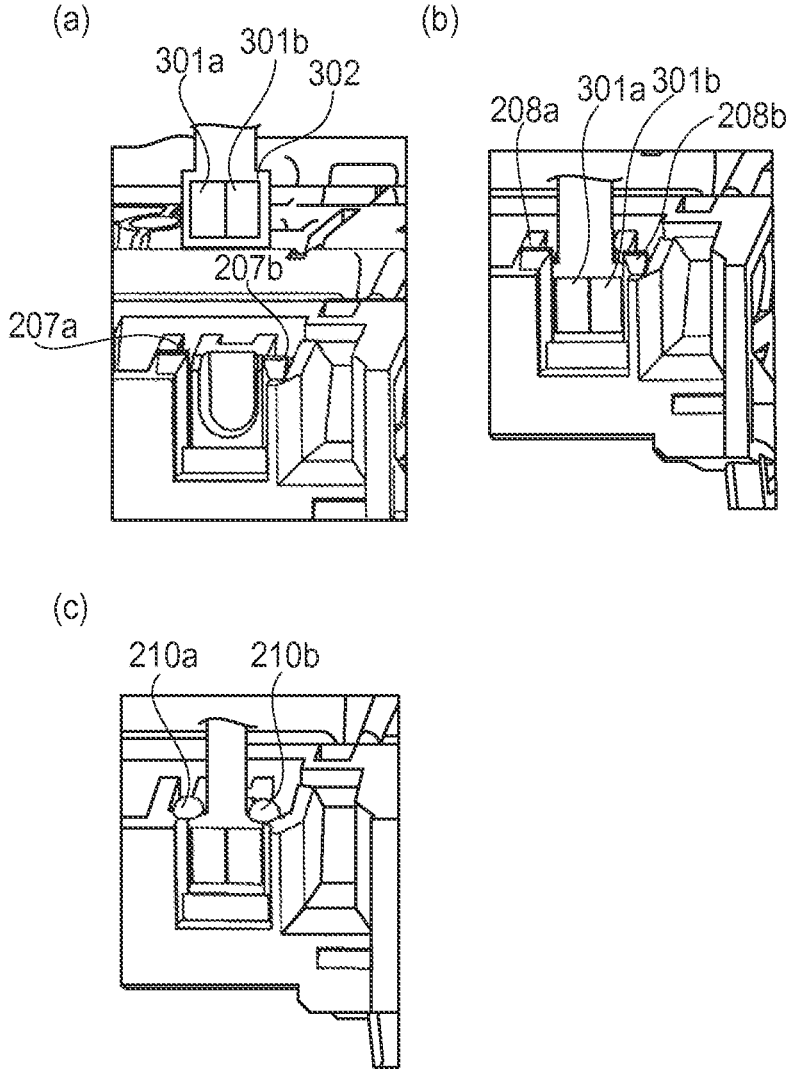
FIG. 10 is a perspective view of the memory, and the memory slot of the main assembly of the image forming apparatus, in the second embodiment of the present invention.

Next, referring to FIG. 10, the second embodiment of the present invention will be described. Incidentally, the apparatuses in this embodiment are the same in basic structure as those in the above described first embodiment. Therefore, they will be not be described to avoid the repetition of the same descriptions; only the structural arrangements that characterize this embodiment will be described. The components, portions, etc., which are the same in function as those in the first embodiment will be given the same referential symbols as those given in the first embodiment.

In the above described first embodiment, the electrical contacts 201*a* and 201*b*, or the electrical contacts on the cartridge side, and the memory 200 are integrally attached to the memory substrate 202. In this embodiment, however, the memory substrate holds only the memory. That is, the electrical contacts on the cartridge side are not integral parts of the memory substrate 202. Incidentally, FIG. 10 does not show the memory substrate in this embodiment, that is, the substrate which holds only the memory.

In this embodiment, the memory which stores the cartridge information is attached to a preset portion of the cartridge 7. The electrical contacts 301*a* and 301*b* of the cartridge 7 are attached to a substrate 302, from which the memory is physically independent. The electrical contacts 301*a* and 301*b* are electrically connected to the memory by unshown wiring. The structure for attaching the substrate 302 to the cartridge 7 is the same as the above described one in the first embodiment.

By rendering the memory physically independent from the electrical contacts of the cartridge, more latitude can be afforded in the positioning of the memory and the electrical contacts therefor in the cartridge 7, improving thereby the cartridge 7 in spatial efficiency.

[Miscellanies]

The preceding embodiments were described with reference to the electrophotographic color image forming apparatus employing a developing method of the contact type, and the cartridge therefor. However, the present invention is also applicable to an electrophotographic monochromatic image forming apparatus, an electrophotographic image forming apparatus of the noncontact type, a development unit mountable in the apparatus main assembly, and a developer unit which is mountable in the apparatus main assembly and stores developer.

In the preceding embodiments, the definition of a process cartridge was a cartridge which has a photosensitive drum and at least one processing means. As examples of the processing means, there are a charging means, a developing means, and a cleaning means. Thus, the process cartridge means: a cartridge in which a charging means, a developing means or a cleaning means, and a photosensitive drum, are integrally disposed, and which is removably mountable in the main assembly of an image forming apparatus; a cartridge in which at least one among a charging means, a developing means, and cleaning means, and a photosensitive drum, are integrally disposed, and which is removably mountable in the main assembly of an image forming apparatus; and a cartridge in which at least a developing means and a photosensitive drum are integrally disposed, and which is removably mountable in the main assembly of an image forming apparatus.

Further, an electrophotographic image forming apparatus means an apparatus which forms an image on recording medium with the use of an electrophotographic image forming method. As examples of an electrophotographic image forming apparatus, an electrophotographic copying machine, an electrophotographic printer (for example, a laser beam printer, an LED printer, and the like), a facsimile apparatus, a word processor, etc., can be included.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 113398/2005, filed Apr. 11, 2005, which is hereby incorporated by reference.

What is claimed is:

1. A cartridge comprising:

a memory for storing information related to the cartridge, the memory disposed on a first surface of a substrate;

an electrical contact disposed on a second surface of the substrate which is opposite to the first surface;

a supporting portion for supporting the substrate so as to expose the electrical contact as seen in a direction of thickness of the substrate, the supporting portion having a slit for limiting movement of the substrate; and a frame provided with the supporting portion, wherein the memory is disposed at a space formed by the frame and the substrate.

2. A cartridge according to claim 1, wherein the space is surrounded by the frame and the substrate.

3. A cartridge according to claim 1, wherein the slit includes an L-shaped regulating member.

4. A cartridge according to claim 1, wherein the slit includes a thickness direction regulating portion for limiting movement of the substrate in the thickness direction of the substrate, and wherein the thickness direction regulating portion is provided so as not to interfere with the memory when a movement of the substrate in the thickness direction of the substrate is regulated by the thickness direction regulation portion.

5. A cartridge according to claim 4, wherein the thickness direction regulating portion includes a plurality of parts disposed at predetermined intervals W1, which satisfies W1>W2, where W2 is a length of the substrate measured in the thickness direction of the substrate.

6. A cartridge according to claim 1, further comprising a widthwise direction regulating portion for limiting movement of the substrate, in a supporting position, in a widthwise direction that is perpendicular to the thickness direction of the substrate, and wherein the widthwise direction regulating portion includes a plurality of parts disposed at predetermined intervals W5, which satisfies W5>W6, where W6 is a length of the substrate measured in the widthwise direction.

7. A cartridge according to claim 1, wherein the electrical contact is formed of copper and is plated with gold.

8. A cartridge according to claim 1, wherein the frame is capable of accommodating toner.

9. A cartridge according to claim 1, wherein the frame includes an electrophotographic photosensitive member.

10. A cartridge comprising:

a frame capable of accommodating toner, a memory for storing information relating to said cartridge;

an electrical contact member including a cartridge electrical contact, wherein said electrical contact member is provided with said memory on a side opposite a side provided with said cartridge electrical contact; and a supporting portion for supporting said electrical contact member at a supporting position so as to expose said cartridge electrical contact as seen in a direction of thickness of said electrical contact member, wherein said supporting portion includes (i) a thickness direction regulating portion for limiting movement of said electrical contact member, in the supporting position, in the thickness direction in a region other than said memory of said electrical contact member, and (ii) a recess provided, in the supporting position, at a position corresponding to said memory.

11. A cartridge comprising:

electrophotographic photosensitive member;

a memory for storing information relating to said cartridge;

an electrical contact member including a cartridge electrical contact, wherein said electrical contact member is provided with said memory on a side opposite a side provided with said cartridge electrical contact; and a supporting portion for supporting said electrical contact member at a supporting position so as to expose said cartridge electrical contact as seen in a direction of thickness of said electrical contact member, wherein said supporting portion includes (i) a thickness direction regulating portion for limiting movement of said electrical contact member, in the supporting position, in the thickness direction in a region other than said memory of said electrical contact member, and (ii) a recess provided, in the supporting position, at a position corresponding to said memory.

* * * * *